US011365377B2

(12) United States Patent
Petermann

(10) Patent No.: US 11,365,377 B2
(45) Date of Patent: Jun. 21, 2022

(54) LIQUID LAUNDRY DETERGENT COMPRISING LAURYL ETHER SULFATE AND BICARBONATE/METASILICATE MIXTURE

(71) Applicant: Global Cosmed Group spolka akcyjna, Jawor (PL)

(72) Inventor: Dieter Petermann, Stadtilm (DE)

(73) Assignee: Global Cosmed Group spolka akcyjna, Jawor (PL)

( * ) Notice: Subject to any disclaimer, the term of this patent is extended or adjusted under 35 U.S.C. 154(b) by 103 days.

(21) Appl. No.: 16/679,381

(22) Filed: Nov. 11, 2019

(65) Prior Publication Data

US 2020/0165548 A1 May 28, 2020

(30) Foreign Application Priority Data

Nov. 26, 2018 (EP) ..... EP18461628

(51) Int. Cl.

| | |
|---|---|
| ***C11D 1/29*** | (2006.01) |
| ***C11D 11/00*** | (2006.01) |
| ***C11D 1/83*** | (2006.01) |
| ***C11D 3/00*** | (2006.01) |
| ***C11D 3/08*** | (2006.01) |
| ***C11D 3/10*** | (2006.01) |
| ***C11D 3/20*** | (2006.01) |
| ***C11D 3/22*** | (2006.01) |
| ***C11D 3/33*** | (2006.01) |
| ***C11D 3/386*** | (2006.01) |
| *C11D 1/14* | (2006.01) |
| *C11D 1/72* | (2006.01) |

(52) U.S. Cl.

CPC ..... *C11D 11/0017* (2013.01); *C11D 1/83* (2013.01); *C11D 3/0021* (2013.01); *C11D 3/08* (2013.01); *C11D 3/10* (2013.01); *C11D 3/2086* (2013.01); *C11D 3/222* (2013.01); *C11D 3/33* (2013.01); *C11D 3/38618* (2013.01); *C11D 3/38627* (2013.01); *C11D 3/38636* (2013.01); *C11D 3/38645* (2013.01); *C11D 3/38663* (2013.01); *C11D 1/146* (2013.01); *C11D 1/72* (2013.01)

(58) Field of Classification Search

CPC .... C11D 1/29; C11D 3/08; C11D 3/10; C11D 3/1246; C11D 3/386; C11D 3/42; C11D 7/12; C11D 7/14; C11D 11/0017

See application file for complete search history.

(56) References Cited

U.S. PATENT DOCUMENTS

| | | | | |
|---|---|---|---|---|
| 3,707,505 | A | 12/1972 | Maeda | |
| 4,081,395 | A * | 3/1978 | Talley | C11D 1/08 510/219 |
| 4,264,457 | A * | 4/1981 | Beeks | D06M 13/463 510/325 |
| 7,304,023 | B2 | 12/2007 | Dasque et al. | |
| 2003/0050218 | A1 | 3/2003 | Geffroy et al. | |
| 2011/0005004 | A1* | 1/2011 | Dykstra | D06L 4/75 8/137 |
| 2017/0044468 | A1* | 2/2017 | Gori | C12N 9/22 |
| 2017/0260480 | A1* | 9/2017 | Stolte | C11D 3/044 |
| 2018/0119291 | A1* | 5/2018 | Huetter | C11D 3/3723 |
| 2018/0216038 | A1 | 8/2018 | Mort et al. | |
| 2019/0177665 | A1* | 6/2019 | Spangenberg | C11D 11/0017 |
| 2020/0109389 | A1* | 4/2020 | Rasmussen | C11D 3/38681 |
| 2020/0347323 | A1* | 11/2020 | O'Connell | C11D 3/386 |

FOREIGN PATENT DOCUMENTS

| | | |
|---|---|---|
| CN | 101165151 A | 4/2008 |
| WO | 9504804 A1 | 2/1995 |

* cited by examiner

*Primary Examiner* — Charles I Boyer

(74) *Attorney, Agent, or Firm* — Dickinson Wright PLLC; Andrew D. Dorisio

(57) ABSTRACT

The invention relates to a liquid laundry detergent composition suitable for cleaning textiles. In addition to at least one surfactant the detergent according to the invention comprises at least one water-soluble metasilicate, at least one water-soluble bicarbonate, at least one water-soluble glutamate and at least one polymeric rheology modifier in an aqueous medium. These components form a detergent framework allowing to reduce the amount of surfactant(s) compared to conventional liquid detergents, which is advantageous for economic, safety and environmental reasons, as less surfactants are consumed and subsequently disposed into wastewater to achieve the similar washing/cleaning performance.

9 Claims, No Drawings

LIQUID LAUNDRY DETERGENT COMPRISING LAURYL ETHER SULFATE AND BICARBONATE/METASILICATE MIXTURE

The disclosure of European Patent No. 18461628.2 filed on Nov. 26, 2018 is hereby incorporated by reference.

FIELD OF THE INVENTION

The invention relates to a liquid laundry detergent composition suitable for cleaning textiles. In particular, the invention relates to a basic framework of a liquid laundry detergent, which is transferable to a series of liquid laundry detergents. By formulating this basic framework the amount of surfactant(s), can be reduced compared to conventional liquid detergents to achieve the similar washing/cleaning performance, which is advantageous for both economic and environmental reasons, as less surfactants are consumed and subsequently disposed into wastewater.

BACKGROUND OF THE INVENTION

Liquid laundry detergent generally containing surfactant component in an amount which, combined with various additives such as enzymes, optical brighteners, phosphonates, etc., allow to achieve good washing results. Table 1 below shows exemplary compositions of different types conventional liquid household detergents and as well as guidelines for individual ingredients.

TABLE 1

Composition of selected conventional liquid household detergents

| | Classic heavy duty liquid laundry detergents Dosage ca. 75 ml | Compact heavy duty liquid laundry detergents Dosage ≤55 ml | Special liquid laundry detergents |
|---|---|---|---|
| Soap | 2-7 wt % | 3-10 wt % | 0.5-5 wt % |
| Anionic surfactants | 10-20 wt % | 15-30 wt % | 2-15 wt % |
| Nonionic surfactants | 3-15 wt % | 5-20 wt % | 2-15 wt % |
| Anionic and nonionic surfactants in total | 15-30 wt % | 25-40 wt % | 10-20 wt % |

All information provided in the table above is shall be considered a guideline only. Individual market products may differ in their composition.

Table 1 shows the complexity of various detergent formulations. In addition to the ingredients mentioned in Table 1, such as anionic surfactants, nonionic surfactants and soaps, the following substances can furthermore be used, depending on the orientation and application of the detergent:

- amphoteric surfactants
- phosphonates, carboxylates
- soil-release-polymers
- optical brighteners
- dye transfer inhibitor
- enzymes—proteases, amylases, lipases, mannanases, pectate lyases, cellulases
- preservatives
- further dyes, opacifiers, perfumes, etc.

The higher the proportion of raw materials used, the higher the share of the same in the wastewater, which directly correlates with the water pollution. In addition, the higher the total surfactant content, the higher the risk of skin and/or eye irritation or damage and/or as well as the higher potential of an allergic reaction in contact with the liquid detergent.

Use of fatty acids or linear alkyl benzene sulfonic acid as acids, which are converted by leaching into soaps or salts of alkyl benzene sulfonic acid, is indispensable in case of many detergents due to very good performance of these substances. Soaps contribute to binding of alkaline earth ions, whereas linear alkyl benzene sulfonic acid salts show extremely good detergency. Depending on the specific type of detergent, the contents of these two substances vary. Soaps as well as linear alkyl benzene sulfonic acid salts can be used directly as such or can be prepared in situ as a result of the above mentioned reaction of respective acids with alkaline media. Since it is an exothermic reaction, washing process using ready-to-use surfactants is safer, but also more expensive.

U.S. Pat. No. 7,304,023 discloses an article comprising a water soluble pouch and a fabric care composition, wherein the first compartment comprises the first component and the second compartment comprises the second component. The first component comprises a cationic fabric softening agent and a non-aqueous liquid matrix. The second component comprises a detersive surfactant. The first component can further comprise a thickener selected from at least one of the following: karaya gum, tragacanth gum, guar gum, locust bean gum, alginate carrageen, xanthan gum, or a combination thereof.

US20180216038 discloses in turn a detergent comprising a polymer and a surfactant, wherein the detergent comprises from 10 wt % to 80 wt % alkoxylated alkyl sulphate anionic detersive surfactant and from 0.5 wt % to 20 wt % of a rheology modifier selected from the group consisting of a non-quaternized alkoxylated polyethyleneimine, wherein said alkoxylated polyalkyleneimine has a polyalkyleneimine core with one or more alkoxy side chains bonded to at least one nitrogen atom in the polyalkyleneimine core, an ethylene oxide-propylene oxide-ethylene oxide (EOx1POyEOx2) triblock copolymer, wherein each of x1 and x2 is in the range of about 2 to about 140 and y is in the range of from about 15 to about 70, an N,N,N',N'-tetra(2-hydroxyethyl)ethylenediamine, and mixtures thereof. The advantage of the detergent is that it is highly-concentrated.

US20030050218 describes preformulated additive for a composition for treating textile fibre articles comprising a particulate solid organic polymer in the form of nanoparticles dispersed in a matrix and a surfactant at the matrix/polymer interface. Water-soluble or water-dispersible alkali metal or alkaline-earth metal silicates, xanthan gum and sodium glutamate are among the compounds which can be used for forming the matrix. The additive according to US20030050218 can be used for protecting textiles against physical or chemical degradation and/or giving them advantages such as softening and crease-resistance properties. Preformulated additive can be used as a care agent in detergent formulations, rinsing/softening formulations, tumble dryer additives and washing additives for textile fibre articles.

Problem to be Solved

One of the problems associated with liquid laundry detergents currently available on the market is their adverse impact on the environment, especially water pollution, due to the high level of surfactants. Another problem associated with relatively high content of surfactants in conventional detergents is irritation of skin or eyes as well as potential allergic activity. Therefore, one object of the invention was to develop a detergent showing improved ecological profile while maintaining high quality and good performance features. Another object of the invention was to provide a detergent being less irritant to the skin and eyes as well as having lower allergic potential.

SUMMARY OF THE INVENTION

The invention is based on the finding that the combination of:

(a) at least one surfactant, (b) at least one water-soluble metasilicate, at least one water-soluble bicarbonate and at least one water-soluble glutamate; and (c) at least one polymeric rheology modifier in an aqueous medium forms a liquid framework formulation capable of providing much better washing effects in a liquid laundry detergent than one could have expected based on the properties of each of the starting materials taken alone. The major effect of the components (b) and (c) is that much less of surfactant (a) is required to achieve the same cleaning/washing performance, thereby allowing to reduce all the above-described negative effects resulting from the use of surfactants in liquid detergents.

Accordingly, the present invention relates to the composition defined in the independent claim 1. Preferred embodiments are defined in the dependent claims.

Surfactants, such as for example anionic surfactant, preferably of the formula $CH_3(CH_2)_m(OCH_2CH_2)_nOSO_3Na$, wherein m=11-14 and n=2, and more preferably sodium lauryl ether sulphate (SLES) are responsible for the primary cleaning performance and are essential components of detergents. However, due to economical, safety and environmental reasons content of surfactants generally reduced as much as possible, without significantly deteriorating the washing power of the detergent.

Waters-soluble bicarbonate such as for example sodium, potassium and/or ammonium bicarbonate, helps to mask water hardness, and also contributes to complexation, degreasing and stain removal.

Under appropriate pH conditions (preferably weakly alkalic such as e.g. 7.5-8.8) a water-soluble metasilicate, such as sodium or potassium metasilicate, contribute to formation of a network structure positively affecting dispersion of dirt particles and providing fibre protection against detached colour pigments (soil release).

Water-soluble glutamate, such as sodium or potassium glutamate, enhances cleaning performance and due to its polar structure shows synergistic effects in ion complexation.

A polymeric rheology modifier, preferably a carbohydrate polymer such as for example xanthan gum, carboxymethyl cellulose or pectin has viscosity-regulating properties and serves to stabilize the system. It also shows a dispersing effect and thus prevents re-contamination.

If the detergent according to the invention comprises at least one enzyme, it generally should comprise as well at least one enzyme stabilizer, preferably selected from formic acid, water-soluble formate, calcium chloride, glycerine and 1,2-propylene glycol.

If the detergent according to the invention is designed for use in washing white laundry, it should preferably comprise an optical brightener. In turn, if the detergent is intended for washing coloured textiles it should preferably contain a dye transfer inhibitor.

Preferably, the detergent according to the invention contains a trisodium citrate, due to its good emulsifying action.

The detergent according to the invention is preferably produced in a method comprising the following steps:

(i) adding at least one polymeric rheology modifier to water, preferably demineralized water, and mixing until it dissolves;

(ii) adding at least one water-soluble metasilicate, at least one water-soluble glutamate and at least one water-soluble bicarbonate, followed by mixing until they dissolve;

(iii) allowing the mixture to swell;

(iv) adding at least one surfactant;

(v) adjusting pH of the detergent to 7.5-8.8.

Although the above sequence of steps (i)-(v) is deemed optimal, the detergent according to the invention can be also produced in a different sequence of the above steps.

Preferably, in the step (ii) at least one water-soluble metasilicate, at least one water-soluble glutamate and at least one water-soluble bicarbonate are added one after another.

Preferably, if enzymes are to be used, the enzyme stabilizers are added in step (ii) after at least one water-soluble glutamate and before at least one water-soluble bicarbonate, and enzymes are added to the detergent in an additional step (vi) following the step (v).

Further ingredients, such as further surfactants and/or perfumes and/or opacifying agents and/or dyes and/or chelating agents and/or preservatives and/or stabilizers and/or optical brighteners or dye transfer inhibitors are preferably added to the mixture between step (iv) and (v).

In the detergent according to the invention at least one polymeric rheology modifier (e.g. xanthan gum), at least one water-soluble metasilicate (e.g. sodium metasilicate) and at least one water-soluble glutamate (e.g. sodium glutamate) form a complex macromolecular network structure. Without being bound by any specific theory it is assumed that this macromolecular structure shows surface-active properties. The macromolecular structure is water-soluble and also binds calcium and magnesium ions, thereby reducing the water hardness. The resulting network structure has a stabilizing effect on the surfactant system and simultaneously binds dirt and grease particles during the cleaning process. Due to the charge properties of the metasilicate and glutamate, pseudo-molecular ion-active complexes are formed within the network structure.

Due to the stabilizing effect on the surfactant system and the inherent ability of the network structure to bind dirt and fat particles, the detergent as a whole requires significantly less surfactants than commercially available products to achieve adequate/similar performance. Due to pronounced secondary washing capacity, the amount of other further customary additives used, such as, for example, phosphonates or carboxylates can also be reduced or even completely dispensed with, depending on the specific application. Therefore, the detergent according to the invention shows comparably good washing/cleaning performance as the traditional detergents, but at the same time, due to lower content of surfactant(s) is cheaper and less harmful to environment. In addition, the use of a relatively low level of surfactants differs the detergent according the present invention from other environmentally-friendly products available on the market, which contain vegetable-based surfactants in much greater amounts, while it happens that some of these products show poorer performance.

Due to its properties, the detergent can be completely dispensed with soaps. In such case, an exothermic reaction step in the fatty acid reaction with concentrated sodium or potassium hydroxide solution is eliminated during production process.

EXAMPLES

Example 1a: Preparation of a Universal Laundry Detergent (Dosage 75 ml Per One Washing Cycle)

The following mixing instruction refers to a volume of the product of 1000 ml. 2.87 g of xanthan gum was added to 667.26 g of demineralized water and mixed vigorously for about 45 minutes until it was dissolved completely. Next, 10.64 g of sodium metasilicate pentahydrate, 2.66 g of sodium glutamate and 31.91 g of sodium bicarbonate were added one after another and the mixture was mixed after addition of each of the constituents until it was completely dissolved. Next 5.53 g of citric acid and 0.085 g of formic acid were added and mixed. The mixture was left for 15 minutes without mixing in order to swell. Next 48.4 g sodium laureth sulphate was added and the mixture was mixed. Further, the following materials could be also add to the mixture at this step: alcohols C13-15, branched and linear, ethoxylated; glycerine; sodium diethylenetriamine pentamethylene phosphonate. The product became viscous. Next, a perfume oil, a colorant, a preservation agent and an optical brightener were added and mixed until the product became less viscous. The pH of the mixture was kept at the level between 7.5 and 8.8. Next, enzymes were added and the mixture was mixed. Finally calcium chloride and the rest of water were added and the laundry detergent was mixed for 20 minutes. The content of the components and their function in the universal laundry detergent are presented in Table 2.

TABLE 2

Composition of a universal laundry detergent of Example 1a.

| Chemical name | CAS | INCI | wt % |
|---|---|---|---|
| Alcohols, C12-14, ethoxylated, sulfates, sodium salts | 68891-38-3 | SODIUM LAURETH SULFATE | 4.55 |
| Alcohols, C13-15, branched and linear, ethoxylated | 157627-86-6 | — | 4.00 |
| Glycerine | 56-81-5 | GLYCERIN | 3.01 |
| Sodium bicarbonate | 144-55-8 | SODIUM BICARBONATE | 3.00 |
| Sodium metasilicate pentahydrate | 10213-79-3 | SODIUM METASILICATE PENTAHYDRATE | 1.00 |
| Diethylene-triamine-penta(methylene phosphonic acid) sodium salt | 22042-96-2 | SODIUM DIETHYLENE-TRIAMINE PENTAMETHYLENE-PHOSPHONATE | 0.96 |
| Citric acid monohydrate | 5949-29-1 | CITRIC ACID | 0.52 |
| Perfume | — | PARFUM | 0.40 |
| Disodium 4,4'-bis(2-sulfon-atostyryl)biphenyl | 27344-41-8 | DISODIUM DISTYRYLBIPHENYL DISULFONATE | 0.30 |
| Xanthan Gum | 11138-66-2 | XANTHAN GUM | 0.27 |
| Monosodium glutamate | 142-47-2 | SODIUM GLUTAMATE | 0.25 |
| Formic acid | 64-18-6 | FORMIC ACID | 0.085 |
| Protease | 9014-01-1 | SUBTILISIN | 0.0528 |
| Calciumchlorid | 10043-52-4 | CALCIUM CHLORIDE | 0.0200 |
| Cellulase | 9012-54-8 | CELLULASE | 0.0185 |
| Mannanase (mannan endo-1,4-beta-mannosidase | 37288-54-3 | MANNANASE | 0.0169 |
| Pectate lyase | 9015-75-2 | PECTAT LYASE | 0.0166 |
| Lipase | 9001-62-1 | LIPASE | 0.0141 |
| Alpha-amylase | 9000-90-2 | ALPHA-AMYLASE | 0.0097 |
| 1,2-Benzoisothiazol-3(2H)-on | 2634-33-5 | BENZISOTHIA-ZOLINONE | 0.0049 |
| Pyridin-2-thiol-1-oxide, sodium salt | 3811-73-2 | SODIUM PYRITHIONE | 0.00240 |
| 2-Methyl-4-isothiazolin-3-on | 2682-20-4 | METHYLISOTHIA-ZOLINONE | 0.00083 |
| Colorant | — | COLORANT | 0.00074 |
| Water | 7732-18-5 | AQUA | up to 100 |

The characteristics of the universal laundry detergent (dosage 75 ml):

pH: 7.5-8.8

Dry matter: 15.5-18 wt %

Example 1b: Preparation of a Universal Laundry Detergent (Dosage 55 ml)

The following mixing instruction refers to a volume of the product of 1000 ml. 3.23 g of xanthan gum was added to 466 g of demineralized water and mixed vigorously for about 45 minutes until it was dissolved completely. Next, 12.92 g of sodium metasilicate pentahydrate, 2.69 g of sodium glutamate and 16.15 g of sodium bicarbonate were added one after another and the mixture was mixed after addition of each of the constituents until it was completely dissolved. Next 5.6 g of citric acid and 0.085 g formic acid were added and mixed. The mixture was left for 15 minutes without mixing in order to swell. Next 121.3 g sodium laureth sulphate, was added and the mixture was mixed. Further the following materials could be also add to the mixture at this step: alcohols C13-15, branched and linear, ethoxylate; glycerine; sodium diethylenetriamine pentamethylene phosphonate. The product became viscous. Next, a perfume oil, a colorant, sodium citrate, a preservation agent and an optical brightener were added and mixed until the product became less viscous. The pH of the mixture was kept at the level between 7.5 and 8.8. Next, enzymes were added and the mixture was mixed. Finally calcium chloride and the rest of water were added and the laundry detergent was mixed for 20 minutes. The content of the components and their function in the universal laundry detergent are presented in Table 2.

TABLE 3

Composition of a universal laundry detergent of Example 1b.

| Chemical name | CAS | INCI | wt % |
|---|---|---|---|
| Alcohols, C12-14, ethoxylated, sulfates, sodium salts | 68891-38-3 | SODIUM LAURETH SULFATE | 12.130 |
| Alcohols, C13-15, branched and linear, ethoxylated | 157627-86-6 | — | 7.700 |
| Glycerine | 56-81-5 | GLYCERIN | 1.720 |
| Sodium bicarbonate | 144-55-8 | SODIUM BICARBONATE | 3.00 |
| Trisodium citrate dihydrate | 6132-04-3 | SODIUM CITRATE | 1.700 |

TABLE 3-continued

Composition of a universal laundry detergent of Example 1b.

| Chemical name | CAS | INCI | wt % |
|---|---|---|---|
| Sodium metasilicate pentahydrate | 10213-79-3 | SODIUM METASILICATE PENTAHYDRATE | 1.200 |
| Diethylene-triamine-penta(methylene phosphonic acid) sodium salt | 22042-96-2 | SODIUM DIETHYLENE-TRIAMINE PENTAMETHYLENE-PHOSPHONATE | 0.960 |
| Citric acid monohydrate | 5949-29-1 | CITRIC ACID | 0.520 |
| Perfume | — | PARFUM | 0.500 |
| Disodium 4,4'-bis(2-sulfon-atostyryl)biphenyl | 27344-41-8 | DISODIUM DISTYRYLBIPHENYL DISULFONATE | 0.345 |
| Xanthan Gum | 11138-66-2 | XANTHAN GUM | 0.300 |
| Mononatriumglutamat | 142-47-2 | SODIUM GLUTAMATE | 0.250 |
| Protease | 9014-01-1 | SUBTILISIN | 0.0984 |
| Formic acid | 64-18-6 | FORMIC ACID | 0.0850 |
| Cellulase | 9012-54-8 | CELLULASE | 0.0344 |
| Lipase | 9001-62-1 | LIPASE | 0.0262 |
| Pectate lyase | 9015-75-2 | PECTAT LYASE | 0.0222 |
| Mannanase (mannan endo-1,4-beta-mannosidase) | 37288-54-3 | MANNANASE | 0.0207 |
| Calcium chloride | 10043-52-4 | CALCIUM CHLORIDE | 0.0200 |
| Alpha-amylase | 9000-90-2 | ALPHA-AMYLASE | 0.0180 |
| 1,2-Benzoisothiazol-3(2H)-on | 2634-33-5 | BENZISOTHIA-ZOLINONE | 0.00640 |
| Pyridin-2-thiol-1-oxid, sodium salt | 3811-73-2 | SODIUM PYRITHIONE | 0.00240 |
| 2-Methyl-4-isothiazolin-3-on | 2682-20-4 | METHYLISOTHIA-ZOLINONE | 0.00160 |
| Colorant | — | COLORANT | 0.00074 |
| Water | 7732-18-5 | AQUA | up to 100 |

The characteristics of the universal laundry detergent (dosage 55 ml):

pH: 7.5-8.8

Dry matter: 24.0-27.0 wt %

Density: 1.050-1.060 g/cm$^3$

Example 2: Biodegradability of the Detergent According to the Invention

The biodegradability of the laundry detergent according to the invention (A) (obtained according to the example 1b) was compared with the biodegradability of four commercial laundry detergents (B)-(E), available on the market, measured as $BOD_5$/COD (biochemical oxygen demand after 5 days/chemical oxygen demand) ratio (see Table 4). This ratio indicates the percentage of components that can be degraded by biological means e.g. in a wastewater treatment plant. High $BOD_5$/COD indicates good biodegradability.

TABLE 4

Biodegradability comparison

| Sample ID | Description/ Name | $BOD_5$/ COD | COD* mg/l | $BOD_5$ mg/l | Dosage for one washing cycle ml | COD for one washing cycle mg |
|---|---|---|---|---|---|---|
| 1 | A | 0.542 | 590.000 | 320.000 | 55 | 32.450 |
| 2 | B | 0.275 | 1200.000 | 330.000 | 55 | 66.000 |

TABLE 4-continued

Biodegradability comparison

| Sample ID | Description/ Name | $BOD_5$/ COD | COD* mg/l | $BOD_5$ mg/l | Dosage for one washing cycle ml | COD for one washing cycle mg |
|---|---|---|---|---|---|---|
| 3 | C | 0.283 | 1200.000 | 340.000 | 60 | 72.000 |
| 4 | D | 0.313 | 1500.000 | 470.000 | 50 | 75.000 |
| 5 | E | 0.353 | 1500.000 | 530.000 | 55 | 82.500 |

*(according DIN ISO 15705: 2003-01 (H45)

**(according DIN EN 1899-1 H51 (1998-05))

The quotient of $BOD_5$ and COD shows impressively reduced ecological footprint of the detergent according to the invention compared to prior art detergents The quotient is significantly higher than that of other products on the market. Another good indicator of the improved eco-friendly properties of the detergent according to the invention is the chemical oxygen demand for a wash cycle (according to the dosage indicated on the label). Table 4 shows that the chemical oxygen demand for a single wash cycle is approximately half of the respective value of this parameter for prior art detergents available on the market. Accordingly, the amount of biodegradable substances released to waste water is significantly reduced in case of the liquid detergents according to the present invention calculated with respect to a dosage per single wash cycle. To sum up, it is noted that the detergent according to the invention (sample A) shows the best biodegradability compared to the other tested products (B)-(E) available on the market.

The invention claimed is:

1. A liquid laundry detergent, comprising at least one surfactant in an aqueous medium, characterised in that said surfactant is sodium lauryl ether sulphate present in amount of 1 to 25 wt %, wherein the detergent further comprises 0.1 to 5.0 wt % of sodium metasilicate, 0.1 to 10 wt % of sodium bicarbonate, 0.01 to 1 wt % of sodium glutamate, and 0.1 to 0.8 wt % of xanthan gum.

2. The detergent according to claim 1, wherein the weight ratio of sodium glutamate to sodium bicarbonate ranges from 1:12 to 12:1.

3. The detergent according to claim 1, wherein the weight ratio of xanthan gum to sodium lauryl ether sulphate is from 1:15 to 1:40.

4. The detergent according to claim 1, wherein the pH of the detergent ranges from 7.5 to 8.8.

5. The detergent according to claim 1, further comprising at least one additive the group consisting of further anionic surfactants, nonionic surfactants, amphoteric surfactants, phosphonates, enzymes, emulsifiers, opacifying agents, dyes, complexing agents, preservatives, perfumes and stabilizers.

6. The detergent according to claim 1, further comprising an optical brightener.

7. The detergent according to claim 1, further comprising a dye transfer inhibitor.

8. The detergent according to claim 5, wherein the complexing agent is trisodium citrate.

9. The detergent according to claim 5, comprising at least one further comprises at least one enzyme stabilizer the group consisting of formic acid, water-soluble formate, calcium chloride, glycerine and 1,2-propylene glycol.

* * * * *